United States Patent [19]

Fremgen

[11] Patent Number: 4,725,247

[45] Date of Patent: Feb. 16, 1988

[54] CABLE SPLICING ASSEMBLY

[75] Inventor: Dieter Fremgen, Wülfrath, Fed. Rep. of Germany

[73] Assignee: Walter Rose GmbH & Co. KG, Hagen, Fed. Rep. of Germany

[21] Appl. No.: 59,234

[22] Filed: Jun. 8, 1987

Related U.S. Application Data

[63] Continuation of Ser. No. 796,098, Nov. 7, 1985, abandoned.

[30] Foreign Application Priority Data

Nov. 13, 1984 [DE] Fed. Rep. of Germany ... 8433159[U]

[51] Int. Cl.[4] ..... H01R 4/24

[52] U.S. Cl. ..... 439/392

[58] Field of Search ..... 439/389, 392, 404, 405, 439/418, 426

[56] References Cited

U.S. PATENT DOCUMENTS

| | | | |
|---|---|---|---|
| 1,290,153 | 1/1919 | Fitzpatrick | 339/98 |
| 1,488,636 | 4/1924 | Geiser | 339/98 |
| 2,469,397 | 5/1949 | Mezek | 339/198 G |
| 2,928,066 | 3/1960 | Gordon | 339/198 G |
| 4,326,767 | 4/1982 | Silbernagel et al. | 339/98 |

*Primary Examiner*—Joseph H. McGlynn
*Attorney, Agent, or Firm*—Toren, McGeady & Associates

[57] ABSTRACT

A device for forming a conductive splice between two wires which includes a casing having formed therein at least two channels within which the wires to be connected are respectively received and a common electrically conductive cutter/clamping member for connecting the wires together deposited into the channels in an insulation-free electrically conducting manner.

12 Claims, 4 Drawing Figures

CABLE SPLICING ASSEMBLY

This is a continuation, of application Ser. No. 796,098, filed Nov. 7, 1985, now abandoned.

The present invention is directed generally to wire splicing devices, and, more particularly, to a device for producing a conductive connection between wires, particularly telephone wires or cables.

The present invention generally involves a device, wherein the conductors or cables are joined together by an electrically conducted element or member within a casing which surrounds the junction.

Conductor connecting sleeves are known in the prior art, whereby simple connection means are utilized. Such connection means consist of an inner contact part with a tip protruding inwardly for the purpose of penetrating the conductor insulation. The tip protrudes from a compression or pressure piece which may be easily deformed and the assembly may also consist of an outer insulating part, for instance, a plastic sleeve. Into these known conductor connecting sleeves, the end of the cables or wires to be connected are inserted and the connecting sleeve is then extruded with a tool so that the inner contact piece penetrates the insulation of the two inserted cable ends so as to connect the conductors in an electrically conductive manner.

In a situation where this conductive connecting sleeve is capable of only connecting respectively one pair of connectors, there are also known so-called conductor connecting ledges or cleats which are equipped with comb-like cutting/clamping members into which the cable conductors may be introduced and connected in an electrically conducting manner. Additionally, they may be shortened by means of extrusion of the housing portion of these ledges or cleats and this is known, for example, from DE-GM No. 82 20 212.

It is common in both forms of connecting devices that during the formation of the splice, for example, in the course of circuitry rearrangement, to require interruption of a plant operation for a short time if the old cable must be removed and a new one spliced in.

Accordingly, the present invention is directed toward providing an approach toward wire splicing with which, in particular, pairs of conductors may be spliced together under normal plant operating conditions without requiring interruption of plant operations, whereby the device will be suitable for being left in place in forming the ultimate splice, as is the case in cable conductor connecting sleeves.

SUMMARY OF THE INVENTION

In accordance with the present invention, there is provided a splicing assembly for producing a conductive connection between two wires, particularly telephone cables, wherein a casing or a housing is provided which is equipped with at least two channels permitting the conductors to be joined together to be passed therethrough. The channels are equipped with a common electrically conducting cutting/clamping member for an insulation-stripped electrically conducting connection of the cables which are deposited into the channels.

The invention makes possible the splicing of new cables in a manner which is completely free of interruption. To begin with, a continuous conductor is deposited into a channel of the device, while the conductor to be spliced in place is also deposited in another channel. By means of the insulation-stripping electrically conductive connection which is effected by the cutting/clamping member, the wire to be spliced in is connected with the continuous conductor without requiring any interruption in the operations of a device to be connected by the wires. The continuous conductor can be cut away to the extent that it is no longer required without any interruption having occurred in the plant operation.

In one aspect of the invention, it is provided that the two channels are essentially arranged at right angles with respect to each other and, in this case, the cutting/clamping element is also suitably designed so as to be rectangular.

Furthermore, in accordance with the invention, at least another channel may be provided in addition to the two through channels which is parallel to one of the two channels and which ends in the device to enable blind introduction of a free end of a connector, whereby the cutting/clamping member extends also so as to be engaging into this channel.

In connection with this solution, it is also provided in the invention that guides for engagement of cutter knives are provided perpendicular to the channels in the pass-through areas of the cable conductors.

The interruption-free splicing operation and the cutting operation may then be performed.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE PREFERRED EMBODIMENT

Figure 1:
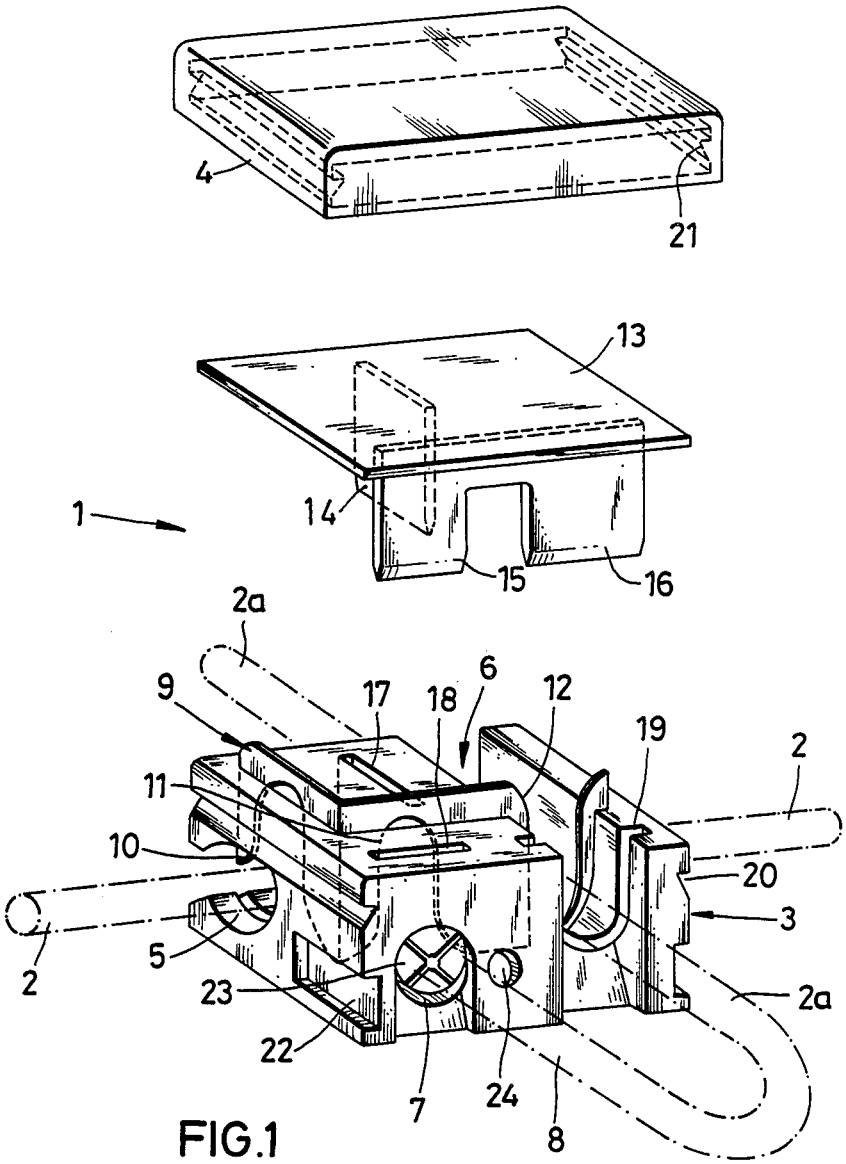
FIG. 1 is an exploded view showing the splicing assembly in accordance with the invention.

Referring now to the drawings and more particularly to FIG. 1, a splicing assembly or device in accordance with the present invention is shown generally designated by the reference numeral 1. The device of the invention may be utilized to join together a first continuous conductor 2 and a second conductor 2*a* which is to be spliced together with the conductor 2. The splicing assembly of the invention consists essentially of a rectangular casing or housing 3 having a cover 4. The casing 3 comprises a pair of channels 5 and 6 which extend at right angles to each other. The channel 5 receives the conductor 2 and the channel 6 receives the conductor 2*a*. In addition to this, the casing 3 is also provided with an additional channel 7 which extends parallel to the channel 6 and which terminates on the outer surface of the casing 3. A free end 8 of the conductor 2*a* may be introduced into the channel 7 in a blind fashion.

The assembly also includes a cutting/clamping element 9 which engages so as to reach into the channels 5, 6 and 7. The element 9 is equipped with contact cutting edges for penetration of the insulation of the conductors 2 and 2a. The contact point for the continuous conductor 2 is identified with reference numeral 10 and the contact point for the free end 8 of the conductor 2a is designated 11. A second contact point for the conductor 2a, after it is returned and deposited into the channel 6, is designated 12.

As will be seen particularly from FIG. 1, the casing 3 is formed with guidance slits 17, 18 and 19 within which knives 14, 15 and 16 may be inserted. The knives 14, 15, 16 are formed with a separate carrier plate 13 and the slits 17, 18, 19 are arranged to extend perpendicularly to the channels 5, 6 and 7, respectively.

Although the carrier member 13 shown in FIG. 1 is of a generally plate-like configuration, it may also be formed, for example, in the shape of pliers (not shown) so that the pliers may be gripped to insert the knives 14, 15 and 16 into the slits 17, 18 and 19. Also, the member 13 may alternatively be formed as an integral part of the cover 4 so that a cutting motion occurs when the cover 4 is mounted on the casing 3.

In the embodiment shown in FIG. 1, a snap-on connection is provided between the housing 3 and the cover 4. This snap-on connection is effected by means of grooves 20 which are formed in the casing 3 and by detent lugs 21 formed in the cover 4, the detent lugs 21 engaging into the grooves 20 when the cover is mounted on the casing 3. The housing 3 is also formed to provide grooves 22 which may be utilized for engagement with a tool which may have formed thereon the knives 14, 15, 16. For example, if, instead of being formed on the carrier plate 13, the knives 14, 15, 16 are formed as part of a pliers-like mechanism, such pliers may be provided with appropriately designed means to engage into the grooves 22 thereby to facilitate formation of the splice.

The insertion of the cutting/clamping member 19 may be performed in one single work step or operation after the insertion of the cable conductors 2 and 2a. Also, subsequent cutting off of the free end 8 or of the portions of the cable conductor 2 which are no longer required may be provided for by insertion of the cutting knives 14, 15 and 16 into the grooves 17, 18 and 19 and the subsequent pressing on of the cover 4.

It may, in practice, be useful for the assembly to provide retention means for the inserted conductors. Particularly, for attachment of the free end 8 of the conductor 2a which is to be spliced in, an arresting device 23 is provided in the channel 7 which consists of plastic segments and which, after introduction of the free end 8 into the channel 7, may retain the end 8 in place.

Figure 2:
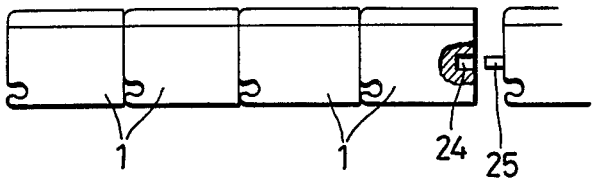
FIG. 2 is a view showing a group of splicing assemblies joined together in a row.

Finally, at least one receiving bore 24 is provided in the casing 3 for acceptance of a pawl pin 25 of an adjoining housing. The utilization of a receiver bore 24 and a pawl pin 25, as shown in FIG. 2, enables casings 3 to be joined together in order to enable attachment of the devices to each other, as indicated in FIG. 2.

Figure 3:
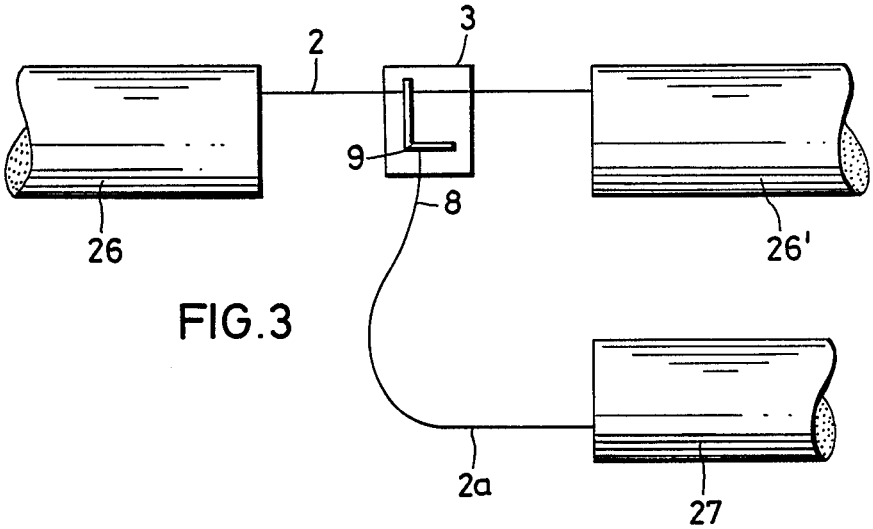
FIG. 3 is a plan view showing the utilization of the device of the invention during an initial stage of the splicing operation.

In the operation of the device of the present invention, the splicing procedure will be explained with particular reference to FIGS. 3 and 4. A continuous conductor 2 may be exposed from an existing cable 26 whose right side is to be spliced off. The conductor 2 is inserted in the pass-through channel 5 and a new cable designated 27 may have separated therefrom a cable conductor 2a which is to be spliced with or attached to the conductor 2. To begin with, the wire or conductor 2a is first introduced with its free end into the channel 7 of the casing 3. The L-shaped cutting/clamping member 9 may now be applied by sliding into place so that the continuous conductor 2 is connected in an electrically conducting manner with the free end 8 of the conductor 2a.

Figure 4:
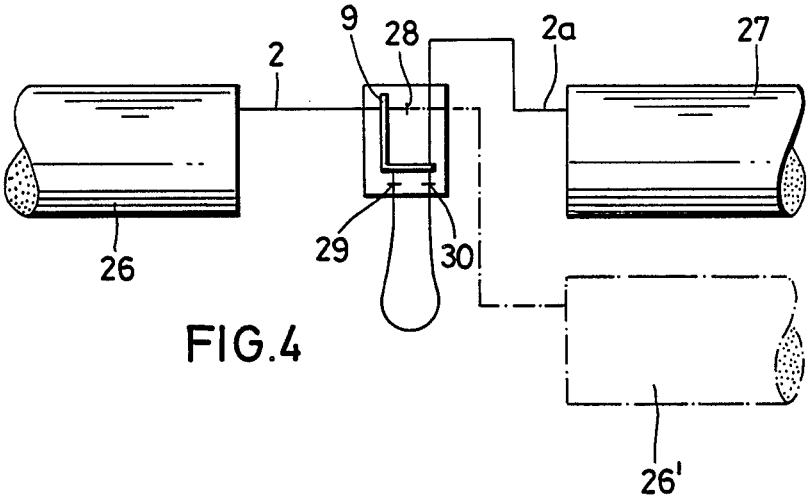
FIG. 4 is a plan view showing a subsequent or final stage of the splicing operation.

Next, the conductor 2a, which is to be spliced in, is arranged in a loop and is turned back through the casing 3 in such a manner as is depicted in FIG. 4 so that the conductor 2a will extend through the continuous channel 6 which extends parallel to the channel 7. At this point, the conductor 2a may be pressed down from above onto the cutter/clamping member 9 so that an electrically conducting connection is produced with the cutter member 9. As a result of this, the conductor 2a will then have two electrical connections formed with the member 9 and it will be connected with the conductor 2 which is still arranged in its continuous form.

The cutting knives 14, 15 and 16 are now inserted from above into the appropriate channels 17, 18 and 19. At this point, the conductor 2 will be cut through at a station 28 and the loop of the conductor 2a will be cut at two places 29 and 30, thereby shortening the conductor 2a. In the course of the entire process, the electrically conducting connection will be continuously maintained.

Naturally, the embodiment described above can be modified in several ways without departing from the principles of the invention. Thus, the invention is not limited to the specific spatial arrangement of the channels described and other parallel angles or the like can also be provided. This also applies to the design of the cutter/clamping member 9 as well as to the cutting knives 14, 15 and 16 and/or the cover 4.

Thus, from the foregoing, it will be seen that the present invention provides a device, wherein, in its initial stages of operation, a continuous conductor 2 is first deposited in a channel 5, as described above. The conductor which is to be spliced together with the first conductor is introduced into the blind channel 7 with its free end 8 and then is formed into a loop with the other end of the conductor 2a being inserted in the other channel 6. The cutting/clamping element 9 is then moved into place and contacts initially with the continuous conductor 2 and twice contacts the conductor 2a which is to be spliced in place due to the formation of the loop shown in FIG. 1.

In order to perform the shortening operation, the cutting knives 14, 15 and 16 are introduced into the guide slits 17, 18 and 19 which are arranged perpendicularly to the channel and the knives operate to cut off the old conductor as well as the loop area of the conductor 2a which is to be spliced in. During this entire operation, no interruption of the electrical lines occurs or is required.

The invention also provides that the cutting knives be arranged in a separate structural part. This separate structural part may, for example, be formed as part of the pressure jaw of a pair of pliers. It is, however, preferred and expedient to also provide the cutting knives directly at the end of the cover 4 so that when the cover is moved into place, the cutting operation is performed.

In accordance with the invention, the casing 3 and the end cover 4 may be equipped, respectively, with means for effecting a snap connection, for example, the grooves 20 provided in the side edges of the casing 3 which are engaged by the corresponding detents 21 formed on the inside of the cover 4. Since, in the case of the present invention, there is involved a device which, in many cases, must be as comparatively small as possible, it may also be provided for the casing to be equipped with engagement grooves for engagement of a pressing tool for exertion of the engagement movement of the cutting/clamping element and/or of the cutting knives and/or the detent connection between the cover and the housing.

It may also be expedient if, at least in the area of the channel ending in the housing, an arresting device for temporary retention of the introduced cable conductor is provided, such as the device 23. This arresting device may, for example, be formed of appropriate butt straps in the insertion opening, or, however, through a molded-on clamping hook behind which the introduced conductor can be clamped.

Finally, the invention additionally provides that the casing 3 be equipped at least on one side with an insertion bore and at the side lying opposite to this insertion bore with a pawl pin for engagement into the insertion bore of an adjoining housing. Thus, a plurality of splicing devices may be joined together to form a strip, such as that shown in FIG. 2, by insertion of the pin 25 into the bore 24.

While a specific embodiment of the invention has been shown and described in detail to illustrate the application of the inventive principles, it will be understood that the invention may be embodied otherwise without departing from such principles.

What is claimed is:

1. A device for producing a conductive splice between a first and a second wire particularly useful for telephone cables comprising:

a casing having formed therein at least two channels, each adapted to receive, respectively, one of said first and second wires to be connected together;

an electrically conductive clamping member for conductively connecting together said first and second wires placed in said channels of said casing, said clamping member cooperating with said casing to clamp said wires in place therein and to penetrate insulation on said wires to establish electrical contact therebetween;

said clamping member being to effect electrical contact with one part of one of said wires when said clamping member is placed in said casing and with another part of said one wire by placement of said another part in contact with said clamping member after said clamping member is placed in said casing; and a cutting device having a plurality of cutting knives selectively arranged to engage into said casing in cooperation with said clamping member for severing from said first and second wires superfluous portions thereof while retaining the electrical contact therebetween established by said clamping member.

2. A device according to claim 1, wherein said two channels are essentially arranged at right angles to each other within said casing.

3. A device according to claim 1, wherein said casing is provided on at least one side thereof with a receiver bore and on a side lying opposite thereto with a pawl pin, said receiver bore being adapted to have engaged therein a pawl pin of another casing for connection together of a pair of said casings.

4. A device according to claim 1, wherein said clamping member is formed as an angular member having three contact slots for engagement therein of portions of said first and second wires, at least two of said contact slots being adapted to receive said wires from opposite sides of said clamping device.

5. A device according to claim 4, wherein said clamping member is formed with two legs angularly extending from each other and wherein one of said legs has one of said three contact slots formed therein and the other of said legs has said at least two of said contact slots formed therein.

6. A device according to claim 1, wherein in addition to said at least two channels an additional channel is formed parallel to one of said two channels and terminating in the device, said additional channel being provided for the blind insertion of a free end of one of said wires and to enable insertion and engagement therein of said clamping member.

7. A device according to claim 6, wherein in said additional channel there is provided an arresting device for temporary retention of a cable wire end inserted therein.

8. A device according to claim 6, further comprising guides formed in said casing provided for engagement therethrough of said cutting knives, said guides being provided to extend perpendicularly respectively to one of said channels.

9. A device according to claim 8, wherein said casing is equipped with engagement grooves for engagement with a pressing tool, said pressing tool having provided thereon at least one of said clamping member and said cutting device.

10. A device according to claim 8, wherein said cutting knives are formed as a component separate from said casing.

11. A device according to claim 10, further comprising a cover member adapted to be engaged with said casing formed as a separate component and having cutting device connected therewith.

12. A device according to claim 11, wherein said casing and said cover member are equipped with means forming a snap-on connection therebetween.

* * * * *